United States Patent [19]

Pertici

[11] 4,321,574

[45] Mar. 23, 1982

[54] TIME DELAY DUAL ELEMENT FUSE WITH GREATER BLOWING TIME ACCURACY

[75] Inventor: Andrew L. Pertici, St. Louis, Mo.

[73] Assignee: McGraw-Edison Company, Rolling Meadows, Ill.

[21] Appl. No.: 199,282

[22] Filed: Oct. 21, 1980

[51] Int. Cl.[3] ..... H01H 71/20; H01H 85/04

[52] U.S. Cl. ..... 337/165; 337/163

[58] Field of Search ..... 337/165, 164, 163, 166, 337/167

[56] References Cited

U.S. PATENT DOCUMENTS

| | | | |
|---|---|---|---|
| 2,400,491 | 5/1946 | Duerkob | 337/165 |
| 2,493,434 | 1/1950 | Yonkers | 29/623 |
| 2,827,532 | 3/1958 | Kozacka | 337/100 |
| 2,832,868 | 4/1958 | Kozacka | 337/222 |
| 2,866,040 | 12/1958 | Skeats | 337/159 |
| 2,988,620 | 6/1961 | Kozacka | 337/165 |
| 3,144,534 | 8/1964 | Baumbach | 337/164 |
| 3,261,952 | 7/1966 | Kozacka | 337/163 |
| 3,735,312 | 5/1973 | Nagel | 337/164 |

*Primary Examiner*—Harold Broome

*Attorney, Agent, or Firm*—Charles W. MacKinnon; Ronald J. LaPorte; Jon Carl Gealow

[57] ABSTRACT

A dual element, time delay fuse with greater blowing time accuracy and improved operating characteristics wherein any bridging of the circuit opening air gaps by molten alloy is effectively precluded during operation of the fuse, especially operation initiated by small protracted overloads. This is accomplished with a fuse element assembly comprising a series connection of a short circuit member, a central absorber member and a heater element member, the central absorber member held to the short circuit member and heater element member by masses of fusing alloy on each of its ends, which masses of fusing alloy are prevented from combining in fabrication and circuit opening operation by flow restricting apertures located near each end of the absorber member.

12 Claims, 9 Drawing Figures

FIG. 5A
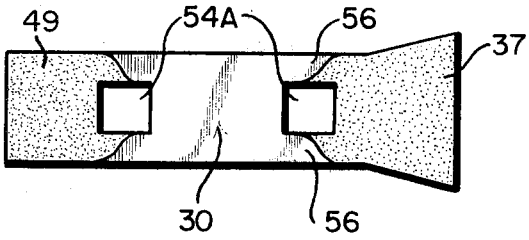
FIG. 5B
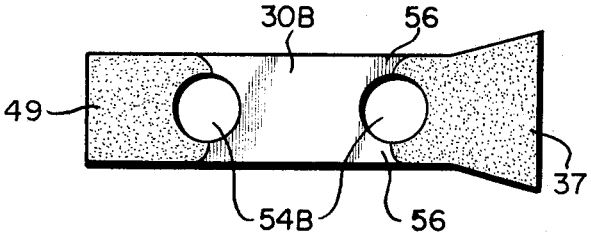
FIG. 5C
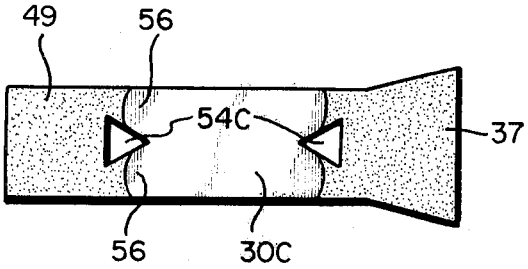
FIG. 5D
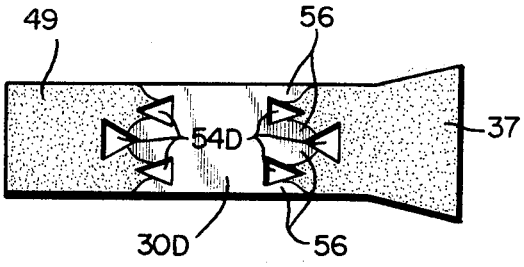
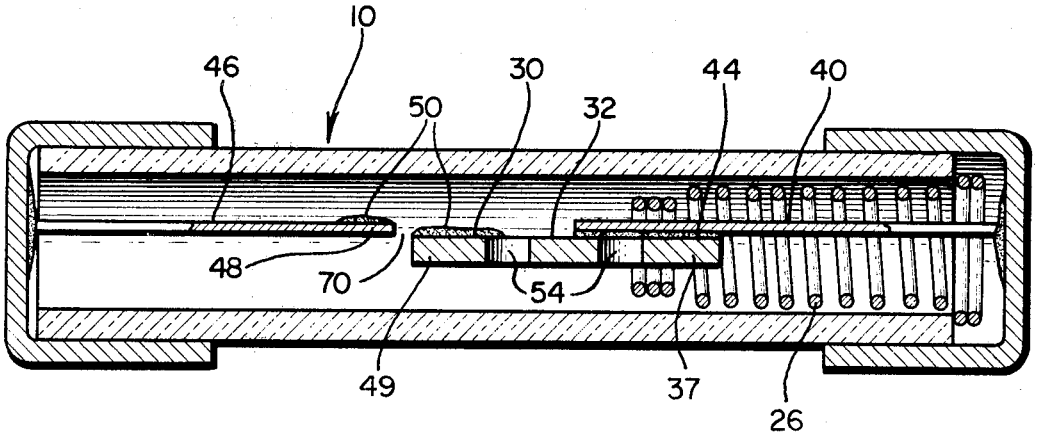
FIG. 6

TIME DELAY DUAL ELEMENT FUSE WITH GREATER BLOWING TIME ACCURACY

BACKGROUND OF THE INVENTION

This invention relates to dual element time delay fuses, and particularly to such fuses having a spring loaded circuit-completing element which is released for circuit opening movement upon conducting an overcurrent. Prior art time delay fuses of this type employ a fusing alloy to hold the circuit completing fuse element in position. Upon conducting an overcurrent, heat is generated internally in the device whereupon the temperature of the fusing alloy is raised in a predetermined fashion to its melting temperature so as to release the spring loaded circuit-completing member. In prior art fuses, an accumulation of fusing alloy was often found to bridge the circuit-opening air gap created during the initial operation of the fuse upon overcurrent. This bridging of the circuit-opening air gap prevents a predetermined consistent operation of the fuse.

SUMMARY OF THE INVENTION

It is therefore an object of this invention to provide a dual element time delay fuse having improved operating characteristics wherein any bridging of the circuit opening air gap by molten alloy is effectively precluded during operation of the fuse, especially operation initiated by small protracted overloads.

Drawbacks of the prior art time delay fuses are overcome by providing a fuse element assembly comprising a series connection of an elongated short circuit member, absorber element member, and heater element member. The absorber element is disposed between the short circuit member and the heater element member and is spring biased for movement away from the short circuit member. This central absorber element is held in place prior to circuit opening operation by first and second masses of fusing alloy which bond the absorber element to the short circuit and heater element members, respectively. The first mass of fusing alloy bonding the central absorber element to the short circuit element is prevented from combining with the second mass of fusing alloy by flow-restricting apertures located near each end of the absorber element. These apertures are provided between the masses of fusing alloy so as to form neck portions of reduced surface width between the center of the absorber element and the masses of fusing alloy disposed at the ends of the absorber element. The apertures are designed to restrict the flow of molten alloy during both fabrication and circuit opening operation to a confined area such that a barrier to further flow is effectively created in the absorber element. Wherein the geometry of the molten alloy mass overlay is not of importance either with respect to fabrication or circuit-opening operation of the fuse, a variety of shapes and number of apertures may be employed in creating the flow restricting means in the time delay fuse of this invention.

BRIEF DESCRIPTION OF THE DRAWINGS

FIG. 5A–5D are plan views of absorber elements including various arrangements of alloy flow restricting apertures according to the invention; and FIG. 6 is a cross-sectional view of the fuse of FIG. 1 illustrated subsequent to the opening thereof.

DETAILED DESCRIPTION OF THE PREFERRED EMBODIMENT

Figure 1:
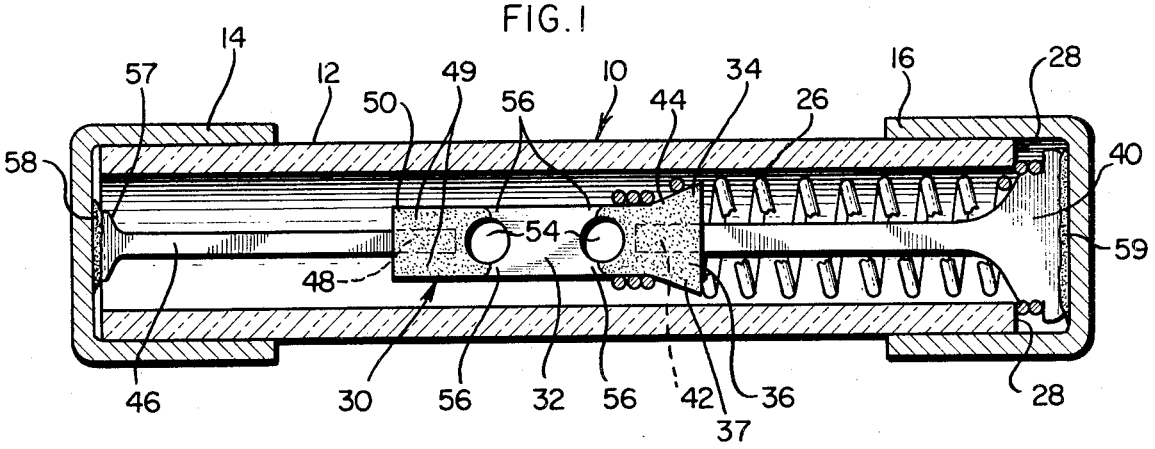
FIG. 1 is a cross-sectional view of a first embodiment of a time delay fuse according to the invention.

FIG. 1 shows a time delay fuse 10 comprising a cylindrical glass sleeve or envelope 12 enclosed at its opposite ends by metallic ferrules 14, 16, respectively. Mounted within glass sleeve 12 are a fuse element assembly 20 and a biasing spring 26 attached between fuse element assembly 20 and end wall 28 of sleeve 12.

Figure 3:
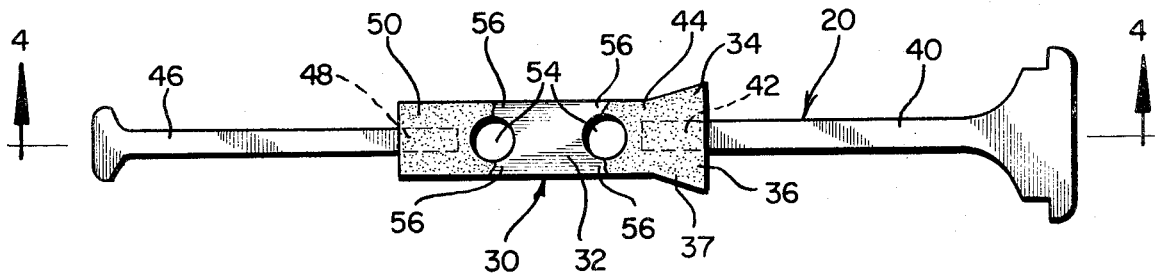
FIG. 3 shows the fuse element assembly of the fuse of FIG. 1.
Figure 4:
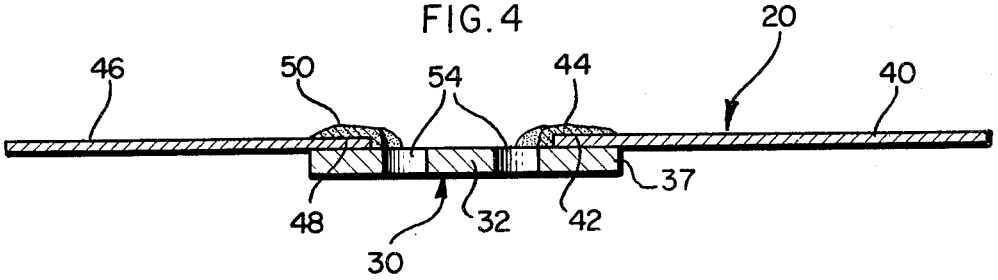
FIG. 4 is a side elevational view of the fuse assembly of FIG. 3.

Referring now to FIGS. 3 and 4, the fuse element assembly 20 comprises an absorber element 30 which is a generally flat, elongated metallic member having a central portion 32, and laterally outwardly extending ears 34, 36 located at a first end 37. A heater element 40 is attached at a first end portion 42 to first end 37 of absorber element 30 by a first mass 44 of fusing alloy. A short circuit strip 46 is attached at a first end 48 to the opposite, second end 49 of absorber element 30 by a second mass 50 of fusing alloy. Short circuit strip 46 has an electrical resistance greater than heater element 40 and heater element 40 has an electrical resistance greater than absorber element 30.

During fabrication of the fuse element assembly 20, ends 48, 42 of short circuit strip 46 and heater element 40, respectively, are overlaid on the respective ends of the absorber element 30 and are then heated. Fusing alloy masses 44, 50 are thereafter applied at each end of the absorber element 30 to form a rigid unitary construction of short circuit strip 46, absorber element 30, and heater element 40. Interposed between the ends of absorber element 30, are defined apertures 54. The provision of apertures 54 form necked down portions 56 of reduced surface width along absorber element 32. The latter maintain alloy masses 44, 50 within defined areas, thereby to effectively restrict the flow of such masses to the central portion 32 of absorber element 30, precluding an accumulation of alloy at end 49 of absorber element 30. The prior art fuses of this type include no such flow restriction, and a build up of alloy mass was frequently experienced during the operation of the fuse. Such build up is effectively prevented by necked down portions 56 as they form a barrier to heat flow inwardly toward central portion 32 of absorber element 30. Necked down portions 56 also impede the flow of molten alloy due to a reduced surface width. Thus, during fabrication, alloy masses 44, 50 are kept separated throughout central portion 32 of absorber element 30.

Referring again to FIG. 1, fuse 10, is assembled by securing metallic ferrule 14 to a corresponding end of sleeve 12 by adhesive or the like fastening means. Spring 26 is then inserted over both short circuit strip 46 and absorber element 30 of fuse element assembly 20. Fuse element assembly 20 and spring 26 are then inserted into the open end or sleeve 12 until the free end 57 of short circuit strip 46 contacts the inside surface of metallic ferrule 14. Free end 57 of short circuit strip 46 is then soldered to metallic ferrule 14 with solder 58 which has a melting temperature considerably greater than that of alloy masses 44, 50. Fuse element assembly 20 is dimensioned such that, as short circuit strip 46 contacts metallic ferrule 14, spring 26 which is engaged by ears 34 and 36 is stretched to a predetermined length after the opposite end of the spring contacts the end wall 28 of sleeve 12. Metallic ferrule 16 is then inserted over the open end of sleeve 12 and is attached thereto by adhesive or other fastening means, and the free end of heater element 40 is then soldered to metallic ferrule 16. It can thus be seen that absorber element 30 is biased for movement to the right by spring 26 upon the melting of alloy masses 44, 50.

Figure 2:
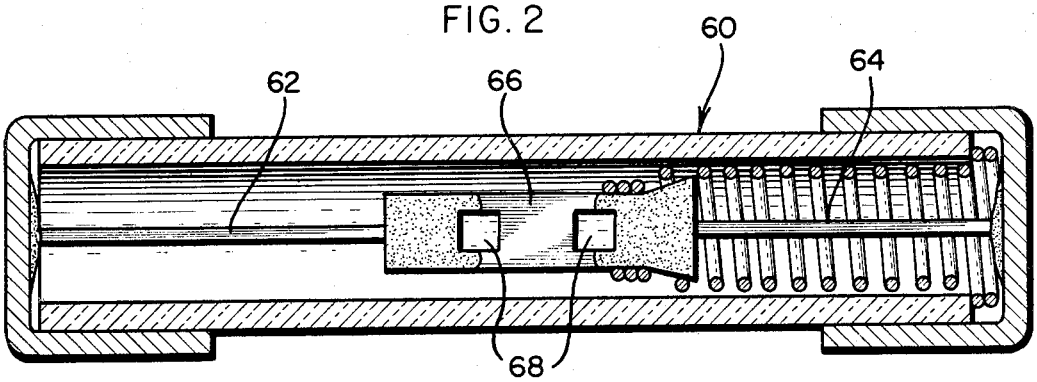
FIG. 2 is a cross-sectional view of a second embodiment of a time delay fuse according to the invention.

Fuse 60 of FIG. 2 is an alternative embodiment of the time delay fuse of the present invention. Two dissimilar wires 62, 64 are substituted for the short circuit strip 46 and heater element 40, respectively, of fuse 10. Wire 64 is a heater wire having slightly lesser resistance than short circuit wire 62. An additional difference from fuse 10 of FIG. 1 is that absorber element 66 of fuse 60 has apertures 68 of square configuration which are the full functional equivalent of the circular apertures 54 of fuse 10.

In operation, when inserted in an external electrical circuit and made to conduct current greatly in excess of the rating of the fuse, electrical energy is transferred to fuse element assembly 20 such that the short circuit strip 46 of fuse 10, or the wire 62 of fuse 60, melts to open the circuit. Strip 46 and wire 62 have a slightly higher resistance than that of strip 40 and wire 64, respectively, to ensure that the circuit opening under high overload conditions does not occur within the strip 40 and wire 64.

Under very small protracted overloads, initial heating of element assembly 20 begins at the short circuit strip 46 and heater element 40. As the entire fuse element assembly 20 is heated, fusing alloy masses 44, 50 are raised to their melting temperature, to thereupon soften and release absorber element 30, allowing it to travel to the right under the bias force of spring 26. As is shown in FIG. 6, circuit opening is accomplished as the second end 49 of absorber element 30 is pulled away from end 48 of short circuit strip 46. Improved operation of the time delay fuse is provided by apertures 54 formed in absorber element 30. These apertures preclude any bridging of the circuit opening air gap 70 (FIG. 6) which would impair the operating performance of the time delay fuse. Adjacent each aperture 54, are necked down portions 56 of reduced surface width. As absorber element 30 is heated, especially under protracted overloads, alloy masses 44, 50 tend to migrate toward central portion 32 of absorber element 30 and to combine therein. Continued melting of fusing alloy masses 44, 50, allows spring 26 to pull absorber element 30 along the surface of heater element 40, the relative action of heater element 40 tending to push fusing alloy mass 44 over the surface of absorber element 30 toward air gap 70. Fusing alloy mass 50 tends to be pulled off the surface of absorber element 30 by surface tension as absorber element 30 is pulled away from short circuit strip 46. Aperture 54 helps to prevent bridging of the circuit opening air gap 70 by allowing smaller quantities of fusing alloy masses 44, 50 to be used in the manufacture of the fuse by restricting flow into the central portion 32 of absorber element 30 at the time of production and by limiting the flow of fusing alloy masses 44, 50 during small protracted overloads, thus decreasing the likelihood that air gap 70 will be bridged by an enlarged mass of molten alloy. Further, the use of a predetermined lesser amount of alloy reduces by a precise amount, the mass of the absorber element 30, thus enhancing the opening time accuracy.

Further, under moderate overload, the heating of absorber element 30 is more pronounced at its ends, and under this operating condition, necked down portions 56 create a thermal barrier to further inhibit the inward migration of molten alloy, especially that of alloy mass 50.

Although the apertures 54 shown in FIG. 1 are circular, apertures of any configuration, such as those shown in FIGS. 2 and 5A through 5D may be used to effectively restrict the inward flow of molten alloy along metallic absorber element 30. As can be seen in FIG. 5D, when a plurality of laterally adjacent apertures 54D are defined in the absorber element, the apertures need not be aligned in any particular geometric pattern so long as the width of necked down portions 56 is sufficiently reduced. Thus, the geometry of the resulting alloy formation at each end or the absorber elements 30 is not critical to the operation of fuse 10, so long as central portion 32 of the absorber element 30 is kept free of molten alloy.

It can be seen that a dual element time delay fuse has been provided with improved operating performance characteristics, and particularly is provided with a more accurate clearing time. While specific embodiments of the fuse according to the invention have been disclosed, other embodiments are possible without deviating from the inventive concept claimed herein.

I claim:

1. A fuse for protecting an electrical circuit comprising:

a series connected first, second and central conductive elements;

said central element including an elongated body portion with a continuous surface, and body portion connected at first and second ends of said surface to said first and second elements respectively, first and second masses of alloy having a predetermined melting temperature connecting said first and second ends of said body portion to said corresponding first and second elements;

means biasing said central element for circuit opening away from said first element in response to the melting of said alloy masses to a molten state; and means defined on the surface of said body portion of said central element for restricting the flow of said molten alloy between said first and second ends of said body portion to maintain said alloy masses separated from each other and to prevent reconnection of said central and first elements thereby.

2. The fuse as recited in claim 1 wherein said second element has an electrical resistance greater than said central element and said first element has an electrical resistance greater than said second element.

3. The fuse as recited in claim 1 wherein said continuous surface of said body portion has predetermined widths at said first and said second ends and said flow restricting means comprises an aperture defined in the surface of said central element interposed between said first and said second ends, said aperture forming one or more portions of reduced surface width thereby to form a barrier to a flow of heat and molten alloy from said first and second ends, respectively, of said central element.

4. The fuse of claim 1 wherein said flow restricting means comprises a series of apertures interposed between said first and said second ends of said body portion, said apertures forming portions of reduced surface width whereby a barrier to the flow of heat and molten alloy is established between said first and second ends of said central element.

5. A time delay fuse as recited in claim 1 wherein said first, second and central elements are of rectangular cross section and have a pair of generally elongated flat opposed surfaces.

6. A time delay fuse as recited in claim 1 wherein said first and said second elements are elongated wires having a predetermined cross-sectional configuration.

7. A time delay fuse including in combination:

a metallic absorber element;

first and second masses of alloy having a predetermined melting temperature at which said alloy flows;

a first current carrying element joined at one end to a first end of said metallic absorber element by said first one of said masses of alloy;

a second current carrying element joined at one end to a second end of said metallic absorber element by said second one of said masses of alloy;

means biasing said metallic absorber element for movement away from said first current carrying element for separation of said first end of said metallic absorber element and said one end of said first current carrying element upon the melting of said masses of alloy;

said metallic element defining means for restricting the flow of melted alloy, thereby to prevent rejoinder of said metallic absorber element and first current carrying element by said alloy.

8. A time delay fuse as recited in claim 6 wherein said means for restricting the flow of melted alloy includes at least one aperture of a predetermined shape defined in said metallic absorber element.

9. A time delay fuse as recited in claim 6 wherein said metallic absorber element is elongated and wherein said means for restricting the flow of melted alloy includes first and second aperture means interposed between the ends of said metallic absorber element.

10. A time delay fuse as recited in claim 8 wherein said first and second aperture means each includes a plurality of predeterminedly shaped apertures defined in said metallic absorber element adjacent opposite ends thereof, each said plurality of apertures being arranged in a predetermined pattern.

11. A time delay fuse as recited in claim 7 wherein said aperture is circular in shape.

12. A time delay fuse as recited in claim 7 wherein said aperture is polygonal in shape.

* * * * *